United States Patent [19]

Kessinger

[11] Patent Number: 4,636,645

[45] Date of Patent: Jan. 13, 1987

[54] CLOSURE SYSTEM FOR A SPENT FUEL STORAGE CASK

[75] Inventor: Boyd A. Kessinger, Murrysville Boro, Pa.

[73] Assignee: Westinghouse Electric Corp., Pittsburgh, Pa.

[21] Appl. No.: 666,944

[22] Filed: Oct. 31, 1984

[51] Int. Cl.[4] ..... G21F 5/00

[52] U.S. Cl. ..... 250/506.1; 376/272

[58] Field of Search ..... 250/506.1, 507.1, 518.1, 250/505.1; 376/203, 205, 272

[56] References Cited

U.S. PATENT DOCUMENTS

| | | | |
|---|---|---|---|
| 3,801,454 | 4/1974 | Kumph | 376/205 |
| 3,926,722 | 12/1975 | Dupen | 376/205 |
| 4,310,034 | 1/1982 | Guilloteau et al. | 376/203 |
| 4,445,042 | 4/1984 | Baatz et al. | 376/272 |
| 4,447,729 | 5/1984 | Doroszlai et al. | 250/506.1 |

FOREIGN PATENT DOCUMENTS

| | | | |
|---|---|---|---|
| 3031211 | 3/1982 | Fed. Rep. of Germany | 250/506.1 |

OTHER PUBLICATIONS

Operation and Maintenance Manual OMM-051-001, dated Feb. 1, 1976, 35 pages.

*Primary Examiner*—Bruce C. Anderson
*Assistant Examiner*—Paul A. Guss
*Attorney, Agent, or Firm*—Daniel C. Abeles

[57] ABSTRACT

A closure system for a storage cask containing spent nuclear fuel has redundant mechanical seals to temporarily close the cask during development, testing, and refinement thereof, when it is occasionally necessary to open the cask, and redundant welded seals to supplement the mechanical seals when development is completed and the cask is permanently sealed during long-term storage. The closure system includes a primary cover which cooperates with an O-ring to provide a mechanical seal and which includes a canopy element that can be welded to the cask base element if a permanent seal is desired. The closure system also includes a secondary cover which cooperates with an additional O-ring to provide an additional mechanical seal and which is configured to receive an additional canopy element in the event that an additional welded seal is desired. The closure system permits the cask to be developed, tested, and refined using the same closure system that will be installed during actual use.

15 Claims, 8 Drawing Figures

FIG. 4.
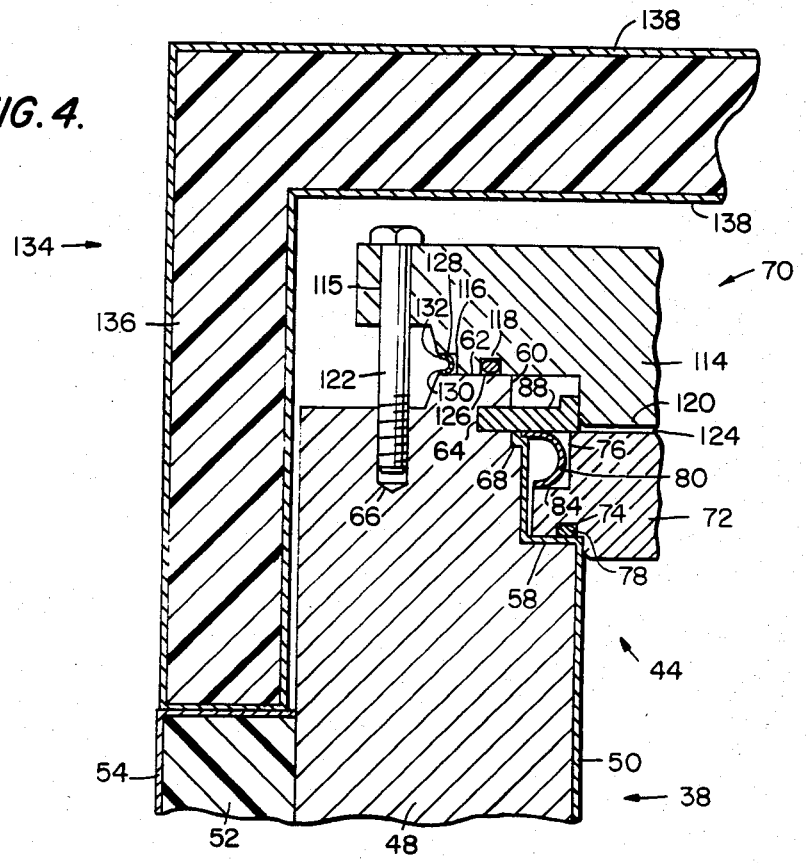
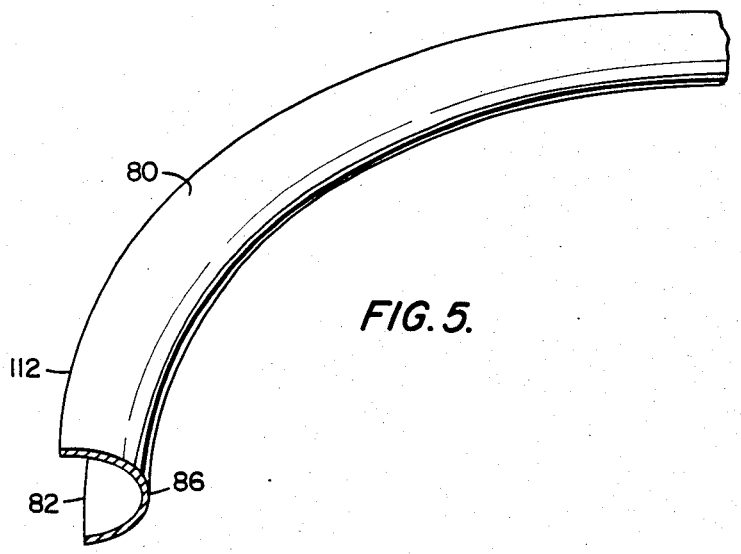
FIG. 5.

CLOSURE SYSTEM FOR A SPENT FUEL STORAGE CASK

BACKGROUND OF THE INVENTION

The present invention relates to the long-term storage of spent fuel that has been removed from a nuclear reactor, and more particularly, to a closure system which can be removeably applied to a spent fuel storage cask during development, testing, and demonstration of the cask and which can also be used to permanently seal the cask during long-term storage, after the development, testing, and demonstration have been completed.

FIG. 1 illustrates a typical fuel assembly 20 for supplying nuclear fuel to a reactor. Assembly 20 includes a bottom nozzle 22 and a top nozzle 24, between which are disposed elongated fuel rods 26. Each fuel rod 26 includes a cylindrical housing made of a zirconium alloy such as commercially available "Zircalloy-4", and is filled with pellets of fissionable fuel enriched with U-235. Within the assembly of fuel rods 26, tubular guides (not shown) are disposed between nozzles 22 and 24 to accommodate movably mounted control rods (not illustrated) and measuring instruments (not illustrated). The ends of these tubular guides are attached to nozzles 22 and 24 to form a skeletal support for fuel rods 26, which are not permanently attached to nozzles 22 and 24. Grid members 28 have apertures through which fuel rods 26 and the tubular guides extend to bundle these elements together. Commercially available fuel assemblies for pressurized water reactors include between 179 and 264 fuel rods, depending upon the particular design. A typical fuel assembly is about 4.1 meters long, about 19.7 cm wide, and has a mass of about 585 kg., but it will be understood that the precise dimensions vary from one fuel assembly design to another.

After a service life of about three years in a pressurized water reactor, the U-235 enrichment of a fuel assembly 20 is depleted. Furthermore, a variety of fission products, having various half-lives, are present in rods 26. These fission products generate intense radioactivity and heat when assemblies 20 are removed from the reactor, and accordingly the assemblies 20 are moved to a pool containing boron salts dissolved in water for short-term storage. Such a pool is designated by reference number 30 in FIG. 2.

Pool 30 is typically 12.2 meters deep. A number of spent fuel racks 32 positioned at the bottom of pool 30 are provided with storage slots 34 to vertically accommodate fuel assemblies 20. A cask pad 36 is located at the bottom of pool 30.

During the period when fuel assemblies 20 are stored in pool 30, the composition of the spent fuel in rods 26 changes. Isotopes with short half-lives decay, and consequently the proportion of fission products having relatively long half-lives increases. Accordingly, the level of radioactivity and heat generated by a fuel assembly 20 decreases relatively rapidly for a period and eventually reaches a state wherein the heat and radioactivity decrease very slowly. Even at this reduced level, however, rods 26 must be reliably isolated from the environmnet for the indefinite future.

Dry storage casks provide one form of long-term storage for the spent fuel. After the heat generated by each fuel assembly 20 falls to a predetermined level—such as 0.5 to 1.0 kilowatt per assembly, after perhaps 10 years of storage in pool 30—an opened cask is lowered to pad 36. The cask typically contains a basket arrangement which provides a matrix of vertically oriented storage slots for receiving spent fuel. By remote control the spent fuel (either in the form of fuel assemblies 20 or in the form of consolidation canisters which contain fuel rods 26 that have been removed from fuel assemblies in order to increase storage density) is transferred to the basket arrangement in the cask, which is then sealed, drained, and flooded with a gas. The cask can then be removed from pool 30 and transported to an aboveground storage area for long-term storage.

The requirements which must be imposed on such a cask are rather severe. The cask must be immune from chemical attack during long-term storage. Furthermore, it must be sufficiently rugged mechanically to avoid even tiny ruptures or fractures during long-term storage and during transportation, when the cask might be subjected to rough treatment or accidents such as drops. Moreover, the cask must be able to transmit heat generated by the spent fuel to the environment while nevertheless shielding the environment from radiation generated by the spent fuel. The temperature of the rods 26 must be kept below a maximum temperature, such as 375° C., to prevent deterioration of the zirconium alloy housing. The basket arrangement in the cask must be able to mechanically support the spent fuel under all realistic conditions while transferring heat generated by the spent fuel to the cask walls. Provisions must also be made to ensure that a chain reaction cannot be sustained within the cask before the water is drained. These requirements impose stringent demands upon the cask, which must fulfill its storage function in an utterly reliable manner.

In view of these demands it is not surprising that a considerable amount of development, testing, and refinement is warranted before a cask is ready for commercial production. It might be desirable to empirically confirm calculations concerning radiation levels or temperature, for example, or to test a new basket arrangement in actual practice. In a similar manner it might be desirable to check the internal condition of the cask or the fuel after a period of storage, or to test cask performance under different storage modes (i.e., intact fuel assemblies or consolidated fuel). In short, it will be apparent that it is desirable, during development, testing, and demonstration of a cask, to seal the cask with a removeable closure system in order to permit access to the cask interior. Nevertheless the object of this testing and refinement is to develop a cask which can be permanently sealed for a long-term storage of spent fuel. Moreover the closure system itself is part of what is tested; that is, it is desirable to test the cask using the closure system which will be used in actual practice.

SUMMARY OF THE INVENTION

Accordingly, one object of the present invention is to provide a closure system which can be removeably applied during development, testing, and demonstration of a cask and which can thereafter be permanently applied, without re-designing either the cask or the closure system, when the cask is used for long-term storage of spent nuclear fuel.

Another object of the present invention is to provide a closure system which employs redundant seals both during the developmental period and during long-term storage.

Another object of the present invention is to provide a closure system which uses mechanical seals during development of the cask but which permits the employment of welded seals during long-term storage.

These and other objects are attained by providing a closure system having a primary cover and a secondary cover which are installed in a cask base element having a stepped mouth region. The primary cover is placed in the stepped mouth region while the cask base element remains in the pool, and its weight compresses a mechanical seal such as a O-ring. The primary cover attenuates radiation sufficiently to permit workers to have brief access to the cask, and shear keys are inserted into a groove in the mouth region of the cask to ensure that the primary cover does not become dislodged as the cask is raised from the pool prior to installation of the secondary cover. If the cask is to be permanently sealed, the shear keys are removed sequentially while a canopy-type welded seal is applied around the periphery of the primary cover. Regardless of whether the cask is to be installed permanently or temporarily, a secondary cover cooperating with a mechanical seal is bolted above the primary cover. If the cask is to be permanently sealed, a canopy-type welded seal is provided at the periphery of the secondary cover.

BRIEF DESCRIPTION OF THE DRAWINGS

FIG. 4 is a sectional view of a poriton of the mouth region, with the closure system of the present application installed;

FIG. 5 is a perspective view of a portion of a canopy element, of the type used to permanently seal the primary and secondary covers of the closure system of the present invention;

DESCRIPTION OF THE PREFERRED EMBODIMENT

Figure 3:
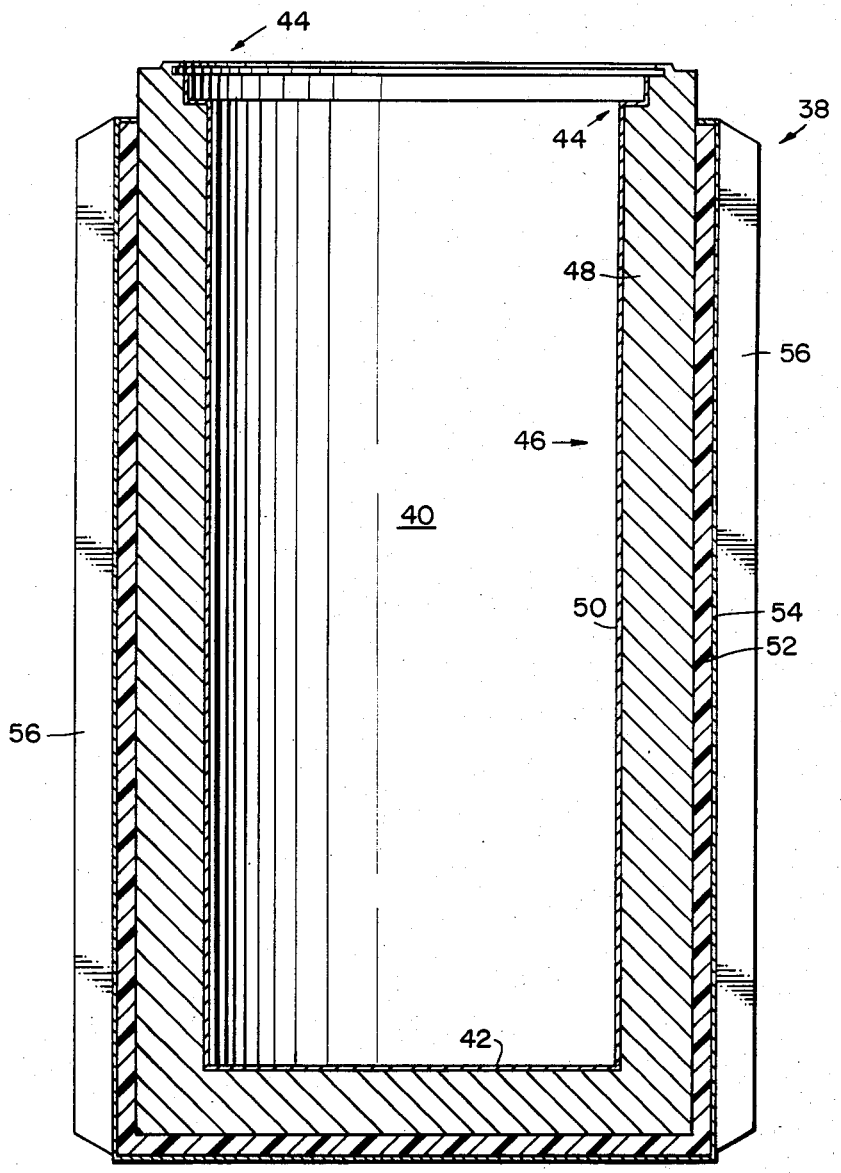
FIG. 3 is a sectional view of a cask base element having a stepped mouth region.

With reference first to FIG. 3, cask base element 38 has a cylindrical cavity 40 which extends from floor 42 to stepped mouth region 44. During use, cavity 40 typically contains a basket arrangement (not illustrated) which mechanically supports the spent fuel in storage slots and which transfers the heat generated thereby to wall 46 of element 38. The storage slots of the basket arrangement have axes that are parallel to the axis of element 38 and are open, in the vincinity of mouth region 44, to receive fuel assemblies 26 and/or fuel in consolidation canisters.

With continuing reference to FIG. 3, cask base element 38 includes a carbon steel portion 48 which is approximately 25 cm thick and which serves to protect the environment from gamma rays. A stainless steel cladding layer 50 is applied to the interior of portion 48, for example, by placing portion 48 on a turntable and rotating it while welding a continuous spiral path around the interior using stainless steel welding rods, so that a stainless steel surface covers the interior of portion 48 entirely in order to protect it from chemical attack. Portion 48 is surrounded by a layer about 7.0 cm thick of neutron absorbing material 52, which may be a resin. A suitable neutron absorbing material is commercially available from Bisco Products, Inc., 1420 Renaissance Drive, Park Ridge, Ill. 60068, under Stock No. NS-3. Surrounding material 52 is an outer layer 54 of stainless steel to protect the cask from the environment. Carbon steel cooling finds 56 are welded to portion 48 and extend through material 52 and layer 54. Element 38 is typically about 4.8 meters high and has an outside diameter of about 2.5 meters, excluding fins 56. It has a mass of over a hundred thousand kilograms when loaded with spent fuel. Trunions (not illustrated) may be provided on element 38 to facilitate handling.

Turning next to FIG. 4, stepped mouth region 44 includes a first annular step region 58 that is horizontally disposed when element 38 is positioned on cask pad 36 (FIG. 2), an annular projection 60 providing a second annular step region 62 which is also horizontally disposed when element 38 is on pad 36, and an annular groove 64 between step regions 58 and 62. Threaded bores 66 are provided around projection 60. Stainless steel layer 50 extends upward to groove 64, where it terminates in a region 68 of increased thickness. This can be accomplished by providing a recess (not numbered) in portion 48 and filling the recess with excess stainless steel when the aforesaid spiral welding with stainless steel rods is performed. Regions 58 and 62 are machined to provide smooth, flat surfaces.

With continuing reference to FIG. 4, closure system 70 cooperates with stepped mouth region 44 to seal base element 38, either temporarily or permanently in order to provide a completed cask. Closure system 70 includes a generally disk-shaped primary cover 72 of stainless steel, about 10 cm thick. The bottom side of primary cover 72 has an annular groove 74 while the top side is provided with an annular recess 76. A first mechanical seal is provided by O-ring 78, which is housed in groove 74 and compressed against first region 58 by the weight of cover 72. it will be apparent that the first mechanical seal could alternately be provided by a O-ring which is housed in a groove that is cut into region 58, or by shallow grooves adjacent each other in both region 58 and cover 72, or by no grooves at all. However it is convenient to permanently install O-ring 78 in groove 74 so that primary cover 72 can be shipped and installed as a single unit.

Referring next to both FIGS. 4 and 5, primary cover 72 includes an annular canopy element 80 of stainless steel. Element 80 can be fabricated, for example, by sawing away the outer portion of a hoop of stainless steel tubing. Bottom edge 82 of canopy element 80 is welded to primary cover 72 at region 84 thereof in such a manner that the weld extends around the periphery of element 72, and intermediate portion 86 of element 80 extends into recess 76. Thus canopy element 80 need not be shipped or installed independently of cover 72.

Figure 2:
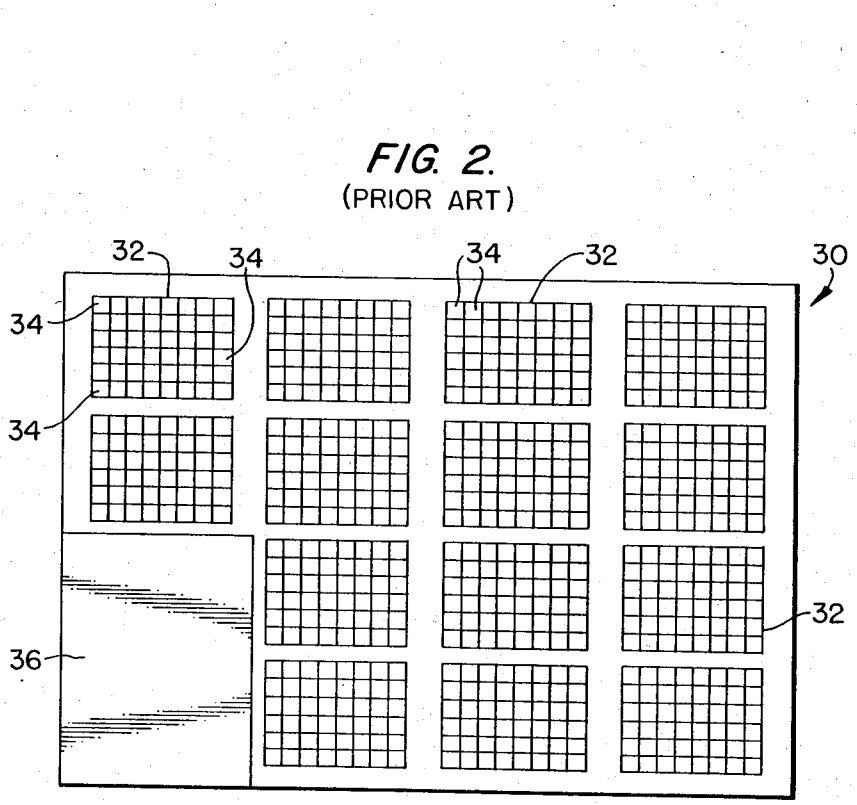
FIG. 2. (PRIOR ART)
FIG. 2 is a top plane view of a pool for short-term storage of spent fuel assemblies.
Figure 1:
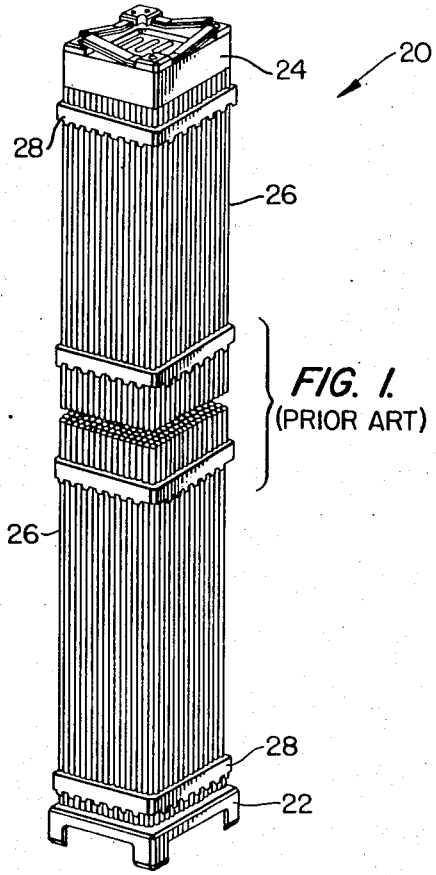
FIG. 1. (PRIOR ART)
FIG. 1 is a perspective view of a typical fuel assembly.

Primary cover 72 is installed under water, after cask base element 38 has been lowered to cask pad 36 (FIG. 2) and loaded with spent fuel. After the loading operation primary cover 72 is lowered by remote control into mouth region 44 until its periphery rests on region 58 of element 38. The weight exerted on O-ring 78 provides a mechanical seal, but shear keys 88 and 90 (FIGS. 6A and 6B) are inserted into groove 64 by remote control, before cask base element 38 is moved, in order to prevent primary cover 72 from becoming displaced during a drop accident or other mishap. After keys 88 and 90 have been installed the water within cask base elements 78 is removed via a drain (not illustrated) and gas is injected. The gas is preferably inert, such as helium, although other gases or even air can be used instead. After primary cover 78 is applied and the water in cask base element 38 is replaced by gas, element 38 is lifted from pool 30 (FIG. 2). Primary cover 72 attenuates the radiation enough to make it safe for workers to be exposed to mouth region 44 for limited periods of time.

Figure 6A:
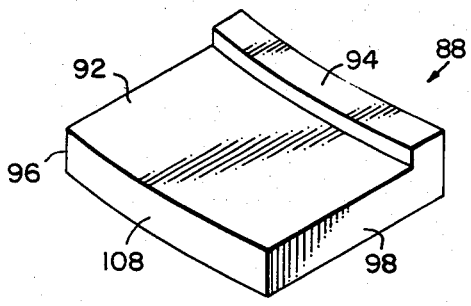
FIGS. 6A and 6B are perspective views of shear keys which are inserted into a groove in the mouth region of the cask base element in order to ensure that the primary cover does not become dislodged before the secondary cover is installed.
Figure 6B:
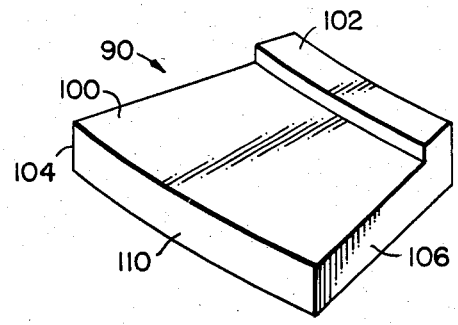

With reference next to FIGS. 6A and 6B, shear keys 88 include insertion portions 92 and riser portions 94, which are bounded by parallel sides 96 and 98. Shear keys 90 include insertion portions 100 and riser portions 102, which are bounded by angularly disposed sides 104 and 106. Shear keys 88 and 90 can be fabricated by machining stainless steel to provide a disk which is as thick as riser portions 94 and 102, reducing the thickness at the periphery of the disk to provide insertion portions 92 and 100, and then cutting away a circular region at the center of the disk to provide an annular structure somewhat resembling in a large washer. The annular structure is thereafter cut into segments to provide individual shear keys 88 and 90.

Figure 7:
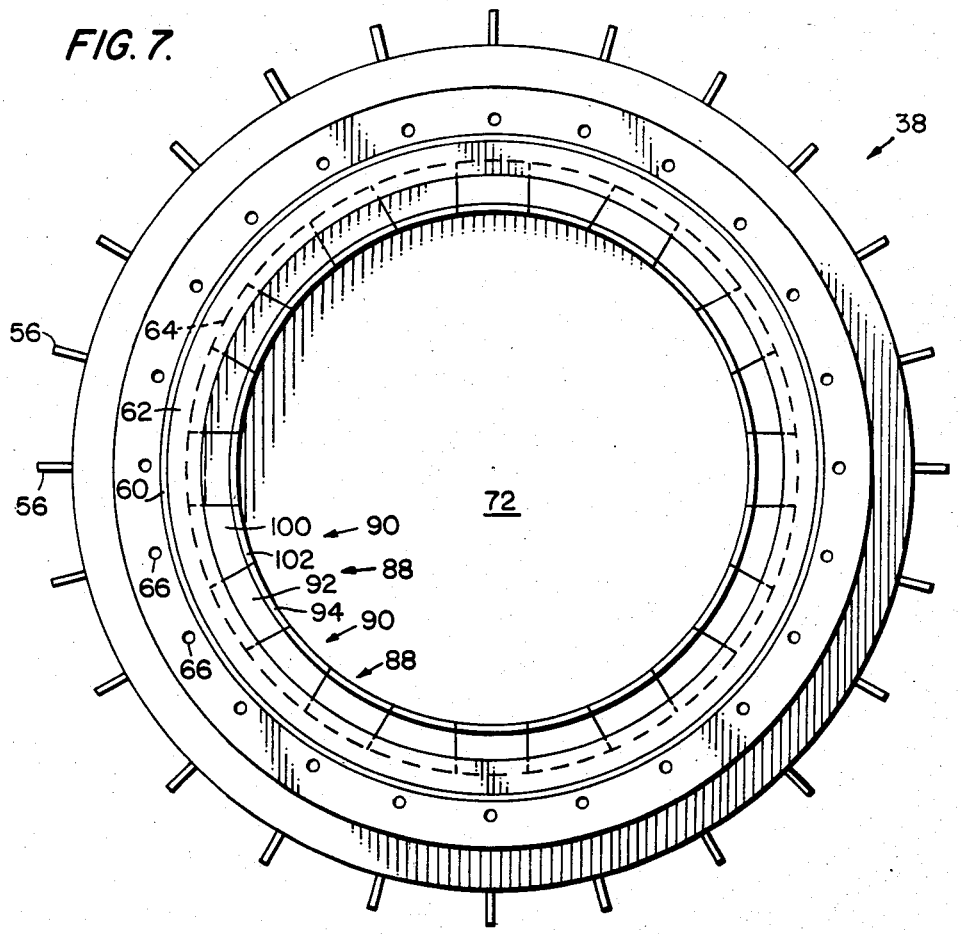
FIG. 7 is a top plan view of the cask base element after the primary cover has been installed and locked into place with shear keys.

FIG. 7 illustrates base element 38 after primary cover 72 has been installed and secured by shear keys 88 and 90. It will be noted that keys 88 and 90 alternate around the periphery of cover 72. The reason why the sides of keys 88 and 90 are configured differently is to permit the keys to be inserted into and removed from groove 64; if the shear keys were fabricated by radially cutting the aforesaid annular element, so that all of the keys were identical, it will be apparent that keys could not be inserted into groove 64 in a full, 360° ring. However since the sides 96 and 98 of shear keys 88 are parallel they can be readily slid into position or removed from groove 64, thereby allowing access to the adjacent shear keys 90. However it is not necessary that sides 96 be parallel to sides 98; keys 88 would still be removeable if sides 96 and 98 sloped toward an apex which is nearer to end 108 than it is to riser portion 94. In contrast, sides 104 and 106 of shear key 90 slope toward an apex that is closer to riser portion 102 than it is to end 110.

Returning to FIGS. 4 and 5, primary cover 72 is installed without welding upper edge 112 of canopy element 80 to region 68 if cask base element 38 is to be temporarily sealed. That is to say, for a temporary seal edge 112 is not welded to base element 38 in the manner shown in FIG. 4, but instead is simply positioned in the upper portion of recess 76 without being permanently connected. If the ask seal is to be permanent, however, shear keys 88 and 89 are removed sequentially to expose segments of canopy element 80, and the portion of edge 112 thereby rendered accessible is welded at region 68. After a segment has been welded the shear keys are re-inserted, whereupon the shear keys are removed from the next segment and welding resumes. This process continues until edge 112 is continuously welded to cask base element 38. It will be apparent that the welding of edge 112 in this manner creates a permanent seal, since edge 82 of element 80 is welded to primary cover 72. Moreover, since there is a degree of flexibility between edges 82 and 112 of element 80, it will be aparent that primary cover 72 can expand differentially with respect to cask base element 38 in response to temperature changes. That is to say, element 80 accommodates minor movement of cover 72 with respect to mouth region 44 without unduly straining the welded seal.

With continuing reference to FIG. 4, closure system 70 also includes a generally disk-shape secondary cover 114 of carbon steel about 15 cm thick. Cover 114 includes bores 115 spaced about its periphery, annular grooves 116 and 118, and central projection 120. Secondary cover 112 is affixed to base element 38, either with edge 112 of canopy element 80 being welded for a permanent seal or not, by bolts 122. Projection 120 is separated by a narrow gap 124 from primary cover 72, thereby accommodating differential expansion while nevertheless providing additional mechanical support in the event that primary cover 72 is jolted during a drop accident. Projection 120 also serves to ensure that shear keys 88 and 90 do not become dislodged.

A second mechanical seal is provided by O-ring 126, which is disposed in groove 118. In the event that the cask is to be permanently sealed a canopy element 128 having lower edge 130 and upper edge 132 is disposed in groove 116 before bolts 122 are inserted, and edges 130 and 132 welded to base element 38 and secondary cover 114, respectively. As was the case with canopy element 80, the welds on canopy element 128 extend all the way around. Canopy element 128 not only permits differential expansion due to temperature changes, it also allows the position of secondary cover 114 to be adjusted slightly during installation of bolts 122 in order to align bores 115 with threaded bores 66.

Cap 134 having a core 136 of neutron absorbing material enclosed by a layer 138 of stainless steel is affixed to base element 38 after the closure system is applied, either temporarily or permanently.

From the foregoing discussion it will be apprent that the closure system of the present invention provides redundant covers each having a mechanical seal for a short-term use if the cask is to be reopened. Since the long-term effectiveness of mechanical seals has not been established, particularly if the cask is flooded with helium, each mechanical seal has a welded back-up seal for use during long-term storage. The welded seals employ canopy elements which permit the covers to move slightly. The primary cover is installed and secured under water, and may be weld-sealed after the cask base element is raised and before the secondary shield is installed. The mechanical seals of the closure system are sufficient during development, testing, and refinement of the cask, and the welded seals can be installed to adapt the cask to long-term storage without re-engineering either the closure system or the mouth region of the cask base element.

It will be understood that the above description of the invention is susceptible to various modifications, changes, and adaptations, and the same are intended to be comprehended within the meaning and range of equivalents of the appended claims.

I claim:

1. A closure system for temporarily sealing a cask base element having a mouth region with first and second steps and for permitting said cask base element to be permanently sealed, said closure system comprising:

a primary cover having a bottom side with a first peripheral region configured for placement on said first step and having a top side with a second peripheral region, an upwardly open annular recess being provided in said primary cover at said secondary peripheral region;

first means disposed between said first peripheral region and said first step for creating a mechanical seal to seal said cask base element at least temporarily;

a generally band-shaped element which is disposed in said annular recess and which has first and second edges and a curved cross section, the first edge being sealingly affixed to said primary cover and the second edge being sealingly affixed to said cask base element only if said cask base element is to be permanently sealed;

a secondary cover having a bottom side with a peripheral region configured for placement on said second step; and second means disposed between the peripheral region of said secondary cover and said second step for creating an additional mechanical seal to seal said cask base element at least temporarily.

2. The closure system of claim 1, further comprising means for creating permanent welded seal between said secondary cover and said cask base element.

3. The closure system of claim 1, wherein said second step of said cask base element is positioned at the top of said cask base element, and wherein the bottom side of said secondary cover has an outwardly open peripheral groove for selectively accommodating an additional generally band-shaped element having first and second edges and curved cross section.

4. The closure system of claim 3, further comprising said additional generally band-shaped element, said additional generally band-shaped element being accommodated in said groove, the first and second edges of said additional generally band-shaped element being sealingly affixed to said cask base element and secondary cover, respectively, only if said cask base element is to be permanently sealed.

5. The closure system of claim 1, further comprising removeable means for securing said secondary cover to said cask base element.

6. The closure system of claim 5, further comprising removeable means for securing said primary cover to said cask base element.

7. The closure system of claim 6, wherein said mouth region has a groove between said first and second steps, and wherein said means for securing said primary cover comprises a plurality of first and second shear keys configured for insertion into said groove between said first and second steps, said first shear keys having sides that are parallel and said second shear keys having sides that are angularly disposed.

8. The closure system of claim 7, wherein said secondary cover has a central projection which is separated from said primary cover by a narrow gap and which prevents said shear keys from becoming dislodged from said groove between said first and second steps.

9. The closure system of claim 8, further comprising a cap having neutron absorbing material therein, said cap enclosing said mouth region and said primary and secondary covers.

10. The closure system of claim 1, wherein said first and second means are O-rings and wherein said curved cross section of said generally band-shaped element is C-shaped.

11. The closure system of claim 10, wherein said mouth region has a groove between said first and second steps, and further comprising shear key means removeably disposed in said groove between said first and second steps for securing said primary cover to said cask base element, and bolts securing said secondary cover to said cask base element.

12. The closure system of claim 11, wherein said second step of said cask base element is positioned at the top of said cask base element, and wherein the bottom side of said secondary cover has an outwardly open peripheral groove for accommodating an additional annular element have a curved cross section.

13. The closure system of claim 12, further comprising said additional annular element, said additional annular element being disposed in the groove in said secondary cover and being welded to both said cask base element and said secondary cover only if said cask base element is to be permanently sealed.

14. The closure system of claim 3, further comprising bolts extending through said secondary cover outward of said groove therein to secure said secondary cover to said cask base element.

15. The closure system of claim 13, further comprising bolts extending through said secondary cover outward of said groove therein to secure said secondary cover to said cask base element.

* * * * *